United States Patent [19]

Hara

[11] 4,391,532

[45] Jul. 5, 1983

[54] ELECTROMAGNETIC ACOUSTIC TRANSDUCER

[75] Inventor: Yoshiaki Hara, Tokyo, Japan

[73] Assignee: Kabushiki Kaisha Daini Seikosha, Tokyo, Japan

[21] Appl. No.: 256,161

[22] Filed: Apr. 21, 1981

[30] Foreign Application Priority Data

Apr. 22, 1980 [JP] Japan ..... 55-53189

[51] Int. Cl.[3] ..... G04C 21/16

[52] U.S. Cl. ..... 368/250; 368/255; 368/72; 368/73; 179/117

[58] Field of Search ..... 368/250, 255, 72, 73; 340/384 R, 384 E, 692, 388, 391, 393, 394, 400, 401; 179/117, 119 R, 115.5 ES; 174/54; 361/399, 395

[56] References Cited

U.S. PATENT DOCUMENTS

| | | | |
|---|---|---|---|
| 4,075,626 | 2/1978 | Sakaguchi et al. | 340/388 |
| 4,222,089 | 9/1980 | MacAskill, Jr. et al. | 361/263 |
| 4,226,491 | 10/1980 | Kazama et al. | 339/17 LM |
| 4,245,274 | 1/1981 | MacDonald et al. | 361/249 |
| 4,295,181 | 10/1981 | Chang et al. | 361/395 |

FOREIGN PATENT DOCUMENTS

| | | | |
|---|---|---|---|
| 55-36762 | 3/1980 | Japan | 368/250 |

*Primary Examiner*—G. Z. Rubinson
*Assistant Examiner*—R. Lev
*Attorney, Agent, or Firm*—Robert E. Burns; Emmanuel J. Lobato; Bruce L. Adams

[57] ABSTRACT

An alarm electronic wristwatch has an electromagnetic acoustic transducer having a base plate having a plurality of upstanding projections, and a lead substrate superposed on the base plate and having a plurality of openings dimensioned to receive respective ones of the projections. The cooperation between the projections and openings enable precise positioning of the lead substrate on the base plate. The lead substrate has a set of cut-out or recessed portions in which are mounted permanent magnets. A magnetic core and excitation coil are mounted on the base plate and the terminals of the excitation coil are connected to an electrode pattern formed on the upper surface of the lead substrate. The lead substrate extends laterally of the transducer to enable electrical connection to a circuit block of the wristwatch from which drive signals may be applied to the excitation coil. A vibratory plate is mounted in spaced-apart relationship from the permanent magnets and the magnetic core so that energization of the coil at preselected alarm times effects vibration of the vibratory plate at a frequency effective to produce an audible sound.

11 Claims, 10 Drawing Figures

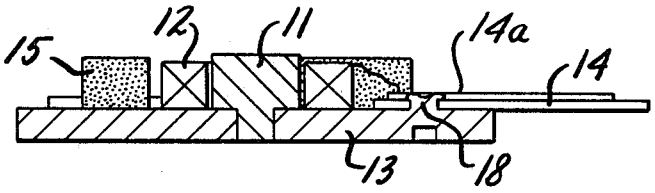
FIG. 4
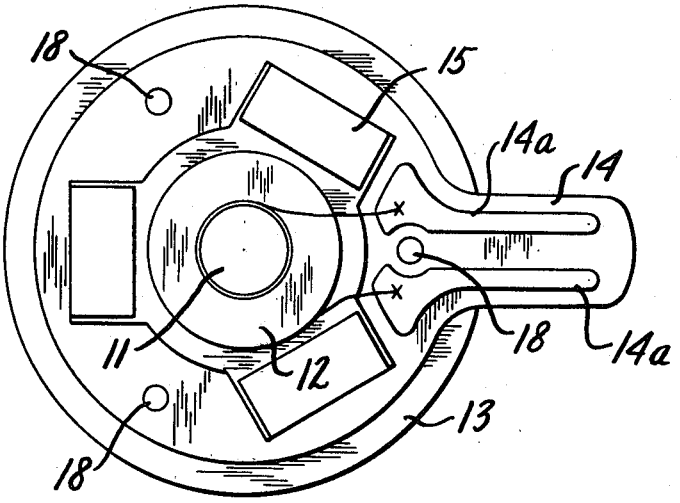
FIG. 5
FIG. 6
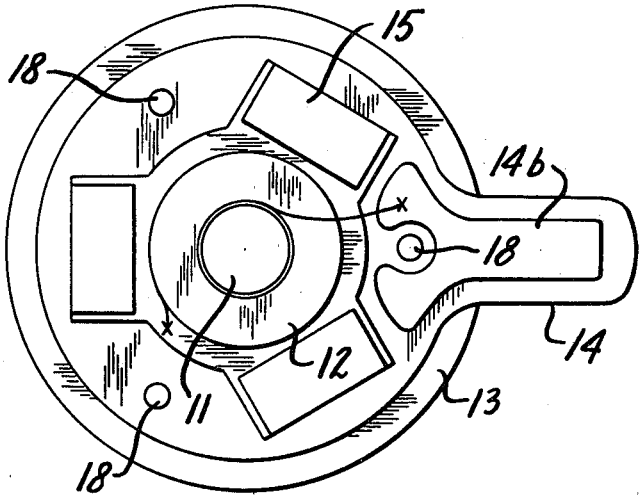
FIG. 7
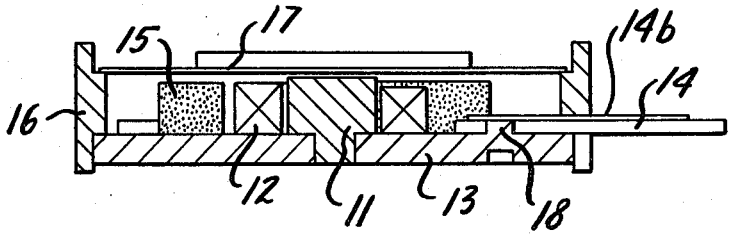

ELECTROMAGNETIC ACOUSTIC TRANSDUCER

BACKGROUND OF THE INVENTION

The present invention pertains generally to electromagnetic acoustic transducers, and more particularly to electromagnetic acoustic transducers of reduced thickness for use as buzzers in alarm electronic timepieces.

Electromagnetic acoustic transducers typically comprise a vibratory member supported at its periphery, and a drive system for electromagnetically driving the vibratory member into vibration to produce an audible sound. The drive system includes an excitation coil wound about a magnetic core and a set of permanent magnets all of which are mounted on a base plate. The two terminals of the coil extend through an opening in the base plate and are connected to electrodes formed on a lead substrate fixed to the underside of the base plate. A set of conductors connect the electrodes to circuitry for applying an alternating current drive signal to the excitation coil.

One drawback of the prior art construction is that it requires connection of the coil terminals to the electrodes on the underside of the lead substrate and such is a delicate and time-consuming manufacturing step. Another drawback is that the transducer requires sufficient space to accommodate the conductors which connect the electrodes on the underside of the lead substrate to the circuitry which applies the drive signal to the transducer thereby preventing a reduction in the thickness of the transducer. A further drawback is that no means are provided for accurately positioning the set of permanent magnets on the lead substrate so that the transducers exhibit different performance characteristics one from the other.

SUMMARY OF THE INVENTION

It is, therefore, one object of the present invention to provide an alarm electronic wristwatch having an electromagnetic acoustic transducer which overcomes the aforementioned drawbacks of the prior art transducers.

Another object of the present invention is to provide an alarm electronic wristwatch having an electromagnetic acoustic transducer of simplified construction and of reduced thickness as compared to prior art transducers.

A further object of the present invention is to provide an alarm electronic wristwatch having an electromagnetic acoustic transducer having means for accurately positioning the set of permanent magnets thereby improving the uniformity and stability of performance among different transducers.

A still further object of the present invention is to provide an alarm electronic wristwatch having an electromagnetic acoustic transducer having means for simplifying the mounting and attachment of the lead substrate to other structures of the transducer thereby permitting an increase in the rate of production of the transducers.

A still further object of the present invention is to provide an alarm electronic wristwatch having an electromagnetic acoustic transducer having means for establishing electrical connection between the excitation coil and the drive circuitry located at the side of the transducer as opposed to at the underside of the transducer as is customary in the prior art construction.

The above and other objects of the invention are achieved by an electromagnetic acoustic transducer which comprises a base plate having a plurality of upstanding projections, and a lead substrate superposed on the base plate and having a plurality of openings dimensioned to receive respective ones of the projections. The cooperation between the projections and openings enable precise positioning of the lead substrate on the base plate. The lead substrate has a set of cut-out or recessed portions in which are mounted permanent magnets. A magnetic core and excitation coil are mounted on the base plate and the coil terminals are connected to an electrode pattern on the upper surface of the lead substrate. The lead substrate extends laterally to enable electrical connection to a circuit block from which drive signals may be applied to the excitation coil. A vibratory plate is mounted in spaced-apart relationship from the set of permanent magnets and the magnetic core so that energization of the coil will effect vibration of the vibratory plate at a frequency effective to produce an audible sound.

Having in mind the above objects as well as other objects of the invention which will become apparent from a reading of this disclosure, the present invention comprises the alarm electronic wristwatches having electromagnetic acoustic transducers as illustrated in the presently preferred embodiments which are hereinafter set forth in sufficient detail to enable those persons ordinarily skilled in the art to clearly understand the manner of practicing the invention when read in conjunction with the accompanying drawings.

BRIEF DESCRIPTION OF THE DRAWINGS

FIG. 4 is a cross-sectional view of the drive portion of an electromagnetic acoustic transducer constructed according to the principles of the present invention;

FIG. 5 is a top plan view of the structure shown in FIG. 4;

FIG. 6 is a top plan view of another embodiment of electromagnetic acoustic transducer constructed according to the principles of the present invention;

FIG. 7 is a cross-sectional view of the transducer shown in FIG. 6;

DETAILED DESCRIPTION OF PREFERRED EMBODIMENTS OF THE INVENTION

Figure 1:
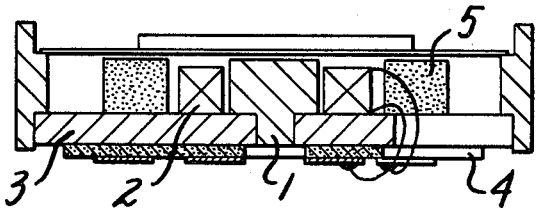
FIG. 1 (PRIOR ART)
FIG. 1 is a cross-sectional view of a typical prior art electromagnetic acoustic transducer.
Figure 2:
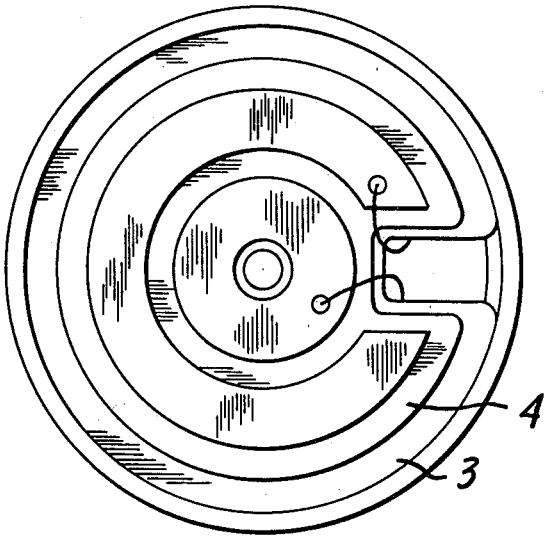
FIG. 2 (PRIOR ART)
FIG. 2 is a bottom plan view of the prior art transducer shown in FIG. 1.

In order to facilitate an understanding of the present invention, a brief description will first be given of a typical prior art construction with reference to FIGS. 1–3. A conventional type electromagnetic acoustic transducer is shown in FIGS. 1–2 and such comprises a magnetic core 1 surrounded by an excitation coil 2 both of which are mounted on a base plate 3. A lead substrate 4 is affixed to the underside of the base plate 3 and is provided with a pattern of circular electrodes for establishing electrical connection between the coil terminals and the drive circuitry. As shown in FIGS. 1–2, the terminals of the coil 2 extend through an opening in the base plate 3 and are soldered or welded to the electrodes on the lead substrate 4. The base plate 3 and lead substrate 4 are composed of electrically insulative material. A set of permanent magnets 5 are mounted in angularly spaced-apart relationship about the excitation coil 2 and are affixed to the base plate 3. A vibratory plate is disposed in spaced relation from the permanent magnets 5 and the magnetic core 1 and is mounted at its periphery to a support member.

Figure 3:
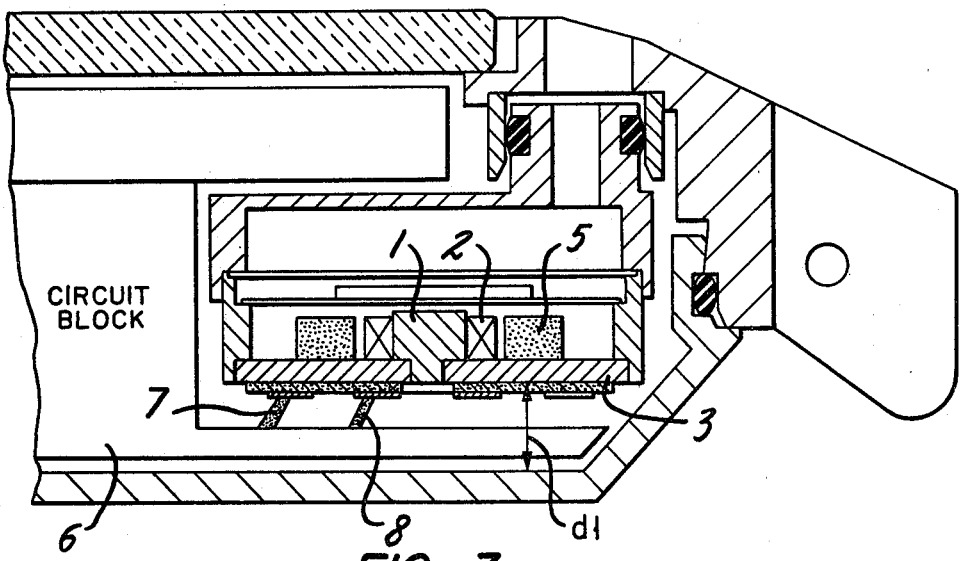
FIG. 3 (PRIOR ART)
FIG. 3 is a cross-sectional view of a prior art type alarm electronic wristwatch incorporating the transducer shown in FIGS. 1–2.

FIG. 3 shows the electromagnetic acoustic transducer of FIGS. 1–2 embodied in an alarm electronic wristwatch. The transducer is disposed within an enclosure which communicates with the exterior of the watch so as to emit the audible sound produced by the transducer. A circuit block 6 includes circuitry for producing an alternating current drive signal for driving the transducer at the desired alarm times. The circuit block 6 is connected to the two terminals of the coil 2 by means of conductors 7 and 8 which electrically connect the circuit block to the electrodes on the underside of the lead substrate 4. The conductors 7 and 8 are usually in the form of lead plates which electrically connect the electrode pattern on the lead substrate 4 to an electrode pattern of the circuit block 6 thereby enabling the drive signal produced by the circuit block to be fed to the excitation coil to vibrationally drive the vibratory plate into producing an audible sound.

Such a prior art construction has several drawbacks. One drawback is that considerable time and skill is required to thread the coil terminals through the opening in the base plate 3 and connect them by soldering or welding to the electrode pattern on the underside of the lead substrate 4. The time required for connection of the coil terminals to the electrode pattern increases the rate or production and thus contributes to an increase in cost of the resulting timepieces. Another drawback is that no means are provided to enable precise positioning of the permanent magnets 5 on the base plate 3 and, therefore, the magnets are positioned and adhered by adhesive to the base plate based on the skill of the worker. As a consequence, the location of the permanent magnets on the base plate varies from transducer to transducer and thus the performance of the transducers vary since the magnetic force of attraction between the magnets and the vibratory plate is different for different transducers because of the different location of the permanent magnets. A further drawback is that the thickness of the transducer is unavoidably increased due to the fact that space is required to accommodate the conductors 7 and 8 and the electrode patterns to which the conductors are connected. As shown in FIG. 3, a thickness dimension d1 is required between the underside of the base plate 3 and the inner surface of the watch casing in order to accommodate the conductors 7 and 8 and their connections to the electrode patterns and to accommodate the connection of the coil terminals to the electrode pattern provided on the underside of the lead substrate 4.

FIGS. 4–5 show one embodiment of the drive portion of an electromagnetic acoustic transducer constructed according to the principles of the present invention. The transducer comprises a magnetic core 11 and an excitation coil 12 wound around the core. Both the core and coil are mounted on a base plate 13. A lead substrate 14 is mounted on the base plate 13 and functions to electrically connect the excitation coil to suitable drive circuitry as well as to position a set of permanent magnets 15 at predetermined positions about the coil.

To simplify mounting of the lead substrate 14 on the base plate 13, the base plate is provided with a plurality of upstanding projections 18 which extend through corresponding openings formed in the lead substrate 14. The projections 18 are formed by a simple press extrusion step during formation of the base plate. As shown in FIG. 4, the top of the projections 18 can be upset or otherwise caulked to fix the lead substrate 14 to the base plate 13. The lead substrate 14 is also provided with a set of cut-out or recessed portions in which are positioned respective ones of the permanent magnets 15. By such a construction, upon mounting of the lead substrate on the base plate, the relative positions of the permanent magnets 15 are precisely determined so that transducers exhibiting uniform and stable operating characteristics can be mass-produced at a high rate of productivity.

An electrode pattern 14*a* is formed on the upper surface of the lead substrate 14. The two terminals of the coil 12 are soldered or welded to the electrodes 14*a*. The electrode pattern is formed on an extension of the lead substrate 14 which extends laterally out from the base plate 13 in a direction which is generally parallel to the major surfaces of the base plate and lead substrate. As described hereinafter, the electrode pattern 14*a* is connected to suitable drive circuitry for applying drive signals to the excitation coil 12.

Another embodiment of transducer is shown in FIGS. 6–7 and this embodiment differs from the prior one with respect to the manner of connection of the terminals of the excitation coil 12. In this embodiment, an electrode pattern 14*b* formed on the lead substrate 14 is connected to one of the coil terminals and the other coil terminal is connected directly to the upper surface of the base plate 13.

FIG. 7 shows further components of the transducer. An annular support frame 16 of circular shape extends around and is connected to the base plate 13 and has an opening therein through which projects the lateral extension of the lead substrate 14. A vibratory plate 17 is attached to and supported by the support frame 16 in spaced apart relationship from the base plate 13 in a manner well known in the art whereby energization of the excitation coil will effect vibration of the plate.

Figure 8:
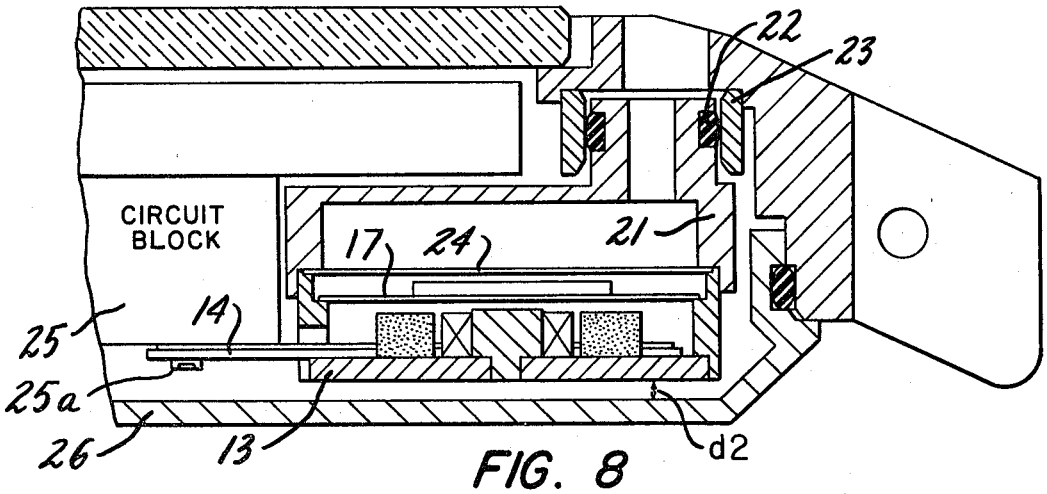
FIG. 8 is a cross-sectional view of an alarm electronic wristwatch incorporating a transducer according to the present invention.
Figure 9:
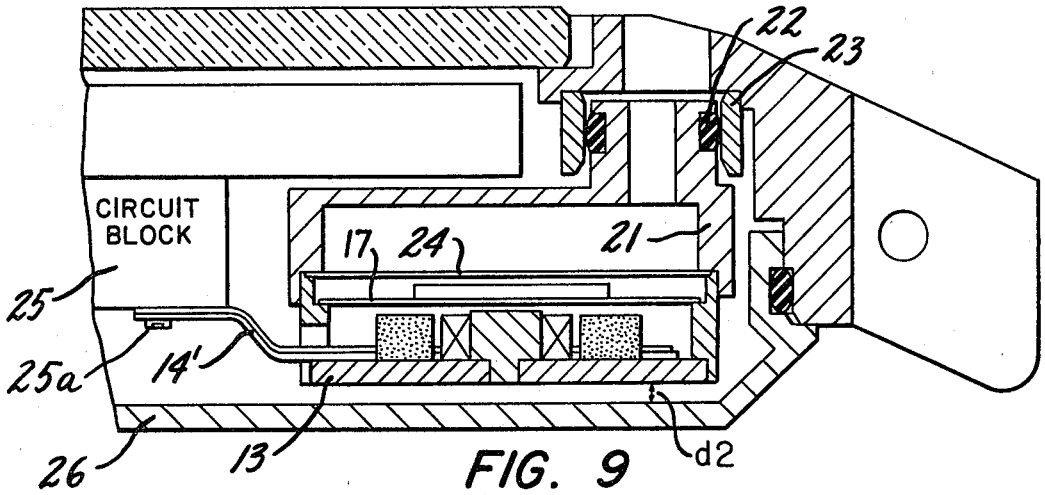
FIG. 9 is a cross-sectional view of an alarm electronic wristwatch incorporating another embodiment of transducer according to the present invention.
Figure 10:
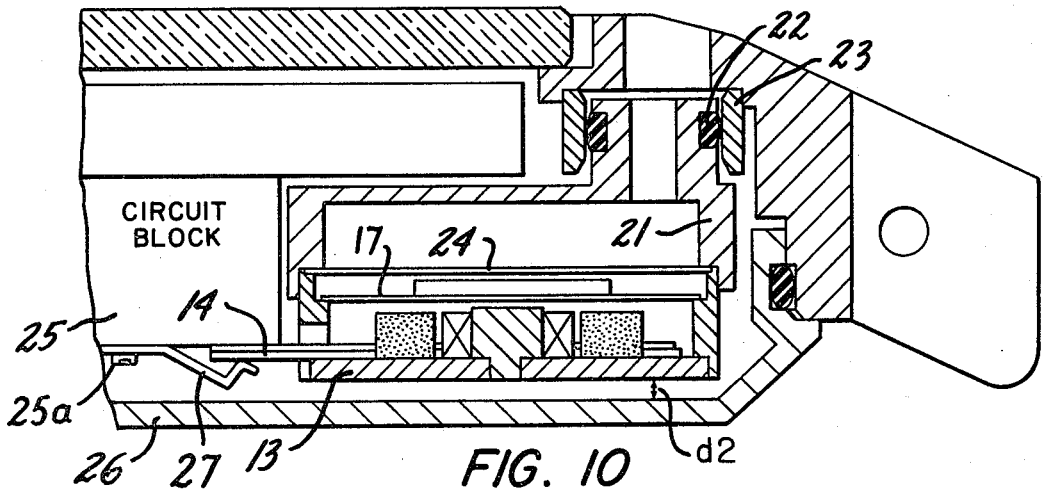
FIG. 10 is a cross-sectional view of an alarm electronic wristwatch incorporating a transducer according to a further embodiment of the present invention.

FIGS. 8–10 show alarm electronic wristwatches embodying transducers constructed according to the present invention. In the embodiment shown in FIG. 8, the transducer is housed within an enclosure 21 which functions as a resonator for the sound emitted by the transducer. The enclosure 21 includes a tubular portion having an annular recess in which is mounted a gasket 22 for fluid-tightly sealing the enclosure to a part 23 of the wristwatch casing. In this embodiment, a second vibratory plate 24 is disposed in spaced relation from the vibratory plate 17 to improve the temperature-dependent characteristics of the transducer. Such a double vibratory plate structure is well known in the art.

The lead substrate 14 exends laterally from the side of the transducer to a circuit block 25. The electrode pattern on the lead substrate 14 is electrically connected to electrodes of the circuit block and a screw 25*a* secures the lead substrate to the circuit block. By such a construction, drive signals generated by the circuit block 25 are applied to the excitation coil to activate the transducer.

As shown in FIG. 8, in accordance with the invention, the lead substrate 14 for connecting the coil terminals to terminals on the circuit block is disposed on the upper surface of the base plate 13 and extends laterally in the lengthwise or widthwise direction of the transducer as opposed to the thickness direction of the transducer. By such a construction, the thickness of the transducer can be considerably reduced as compared to prior art transducers since no space is needed to accommodate any parts between the base plate 13 and the back cover of the watch casing 26. In FIG. 8, a relatively small thickness dimension d2 exists between the underside of the base plate 13 and the inner surface of the watch casing 26. The dimension d2 is considerably less than the dimension d1 of the prior art construction shown in FIG. 3 and thus it can be appreciated that in accordance with the present invention, the thickness of the transducer can be reduced and thus the overall thickness of the watch can be reduced.

FIG. 9 shows another embodiment which differs from that shown in FIG. 8 by using a flexible lead substrate 14'. Such a substrate can be formed from a flexible printed circuit board and has the advantage of providing flexibility in layout and design of the watch. Like the embodiment shown in FIG. 8, this embodiment enables construction of watches of reduced thickness since the relatively small thickness dimension d2 exists between the base plate 13 and the watch casing 26.

The embodiment shown in FIG. 10 is similar to the previous embodiments except for the manner of connection of the lead substrate 14 to the circuit block 25. In this embodiment, a spring member 27 resiliently clips the lead substrate 14 to the circuit block 25. The advantage of this embodiment is that the spring member 27 may be used to connect a plurality of elements to the circuit block though for sake of clarity, the connection of other elements has been omitted from FIG. 10. As in the prior embodiments, a thickness dimension d2 exists between the base plate 13 and the casing 26 so that the overall thickness of the watch is considerably reduced as compared to prior art constructions. As shown in FIGS. 8–10, the distance d2 is on the order of the thickness of the base plate 13.

The present invention provides a simple means for positioning the lead substrate on the base plate thereby dispensing with the more elaborate adhering step required in prior art constructions. The present invention also enables precise positioning of the permanent magnets thereby obtaining transducers which exhibit uniform and stable performance characteristics. The invention also eliminates the external soldering step required in the prior art constructions for attaching the coil terminals to the underside of the base plate. Further, the invention enables construction of thinner watches since the coil terminals are connected through leads which extend from the side of the transducer as compared to the prior art constructions in which the coil terminals are connected through conductors extending from the underside of the base plate.

Obvious changes and modifications will become apparent to those skilled in the art and the present invention is intended to cover all such modifications and changes which fall within the spirit and scope of the invention as defined in the appended claims.

I claim:

1. In an alarm electronic wristwatch having a watchcase: an electromagnetic acoustic transducer comprising a base plate having an upper surface and an undersurface and having a plurality of upstanding projections projecting upwardly from the upper surface, a magnetic core, an excitation coil surrounding the magnetic core, a set of permanent magnets, the core, coil and permanent magnets all being supported by the base plate, a vibratory plate mounted in spaced relation from the magnetic core to undergo vibration in response to the application of a drive signal to the excitation coil, a support frame of generally circular shape extending around the base plate and having an opening therethrough, a lead substrate comprised of flexible material mounted on the upper surface of the base plate and having a lead substrate extension projecting through the support frame opening and having a plurality of openings receiving therein respective ones of the base plate projections, the base plate projections cooperating with the lead substrate openings to position the lead substrate on the base plate at a predetermined position, an electrode pattern on the lead substrate, and means electrically connecting at least one of the terminals of the excitation coil to the electrode pattern for applying drive signals to the excitation coil; means mounting the electromagnetic acoustic transducer within the watchcase with the undersurface of the base plate disposed opposite an inner surface of the watchcase; and a circuit block connected to the lead substrate extension projecting through the opening of the support frame for generating drive signals at pre-selected alarm times and applying the drive signals to the electrode pattern to thereby activate the transducer.

2. In an alarm electronic wristwatch having a watchcase: an electromagnetic acoustic transducer operable when activated for producing an audible alarm sound comprising a base plate having an upper surface and an undersurface, a magnetic core disposed on the base plate upper surface, an excitation coil having a pair of terminals and surrounding the magnetic core, a set of permanent magnets disposed on the base plate upper surface, a vibratory plate mounted in spaced relation from the magnetic core to undergo vibration in response to the application of a drive signal to the excitation coil, an annular support frame connected to and supporting the base plate and vibratory plate in spaced apart relationship and having an opening therethrough, a lead substrate mounted on the base plate upper surface and having an extension which extends laterally of the support frame through the support frame opening, an electrode pattern on the lead substrate and extending along the lead substrate extension, and means disposed within the enclosure defined by the support frame and the base and vibratory plates for electrically connecting at least one of the terminals of the excitation coil to the electrode pattern for applying drive signals to the excitation coil; means mounting the electromagnetic acoustic transducer within the watchcase with the base plate undersurface disposed directly opposite an inner surface of the watchcase; and circuit block means connected to the electrode pattern which extends along the lead substrate extension outside of the enclosure for generating drive signals at pre-selected alarm times and applying the drive signals to the electrode pattern to thereby activate the electromagnetic acoustic transducer.

3. An alarm electronic wristwatch according to claim 2; wherein the base plate has a plurality of upstanding projections; and the lead substrate has a plurality of openings receiving therein respective ones of the projections thereby positioning the lead substrate on the base plate at a predetermined position.

4. An alarm electronic wristwatch according to claim 2; wherein the lead substrate has means for positioning the set of permanent magnets in predetermined positions.

5. An alarm electronic wristwatch according to claim 4; wherein the means for positioning the set of permanent magnets comprises recessed portions in the lead substrate in which are positioned respective ones of the permanent magnets.

6. An alarm electronic wristwatch according to claim 2; wherein the electrode pattern comprises a pair of lead electrodes extending along the lead substrate extension and connected to respective ones of the terminals of the excitation coil.

7. An alarm electronic wristwatch according to claim 2; wherein the electrode pattern comprises a lead electrode extending along the lead substrate extension and connected to one terminal of the excitation coil; and means electrically connecting the other terminal of the excitation coil to the base plate.

8. An alarm electronic wristwatch according to claim 2; wherein the lead substrate is comprised of flexible material.

9. An alarm electronic wristwatch according to claim 2; wherein the distance between the base plate undersurface and the watchcase inner surface in the thickness direction of the wristwatch is less than would otherwise be the case if the lead substrate were mounted on the base plate undersurface.

10. An alarm electronic wristwatch according to claim 9; wherein the space between the base plate undersurface and the watchcase inner surface is free of any watch circuit parts.

11. An alarm electronic wristwatch according to claim 9; wherein said distance is on the order of the thickness of the base plate.

* * * * *